US005318656A

United States Patent [19]

Dylla et al.

[11] Patent Number: 5,318,656

[45] Date of Patent: Jun. 7, 1994

[54] APPARATUS OF PREPARING A ROLL OF PRINTING SUBSTRATE WEB FOR FLYING PASTING

[75] Inventors: Norbert Dylla, Stadtbergen; Anton Hamm, Neusäss; Otto Spang, Gessertshausen, all of Fed. Rep. of Germany

[73] Assignee: Man Roland Druckmaschinen AG, Offenbach am Main, Fed. Rep. of Germany

[21] Appl. No.: 882,599

[22] Filed: May 13, 1992

[30] Foreign Application Priority Data

Jun. 7, 1991 [DE] Fed. Rep. of Germany ..... 4118690

[51] Int. Cl.[5] ..... B65H 19/18; B32B 31/00

[52] U.S. Cl. ..... 156/357; 156/504; 156/505; 156/527; 156/356; 242/58.1; 242/58.5; 206/389

[58] Field of Search ..... 156/505, 523, 524, 157, 156/527, 356, 357, 184, 187, 502, 504; 206/389; 242/56 R, 58.1, 58.5

[56] References Cited

U.S. PATENT DOCUMENTS

| | | | |
|---|---|---|---|
| 1,975,348 | 10/1934 | Cline | 242/58.5 |
| 2,104,774 | 1/1938 | Scott | 242/58.5 |
| 2,377,971 | 6/1945 | Roeson | 242/58.5 |
| 2,596,189 | 5/1952 | Wieking | 242/58.5 |
| 2,812,145 | 11/1957 | Meloche | 242/58.5 |
| 3,532,573 | 10/1970 | Herman | 156/184 X |
| 3,547,739 | 12/1970 | Beute | 156/504 |
| 3,741,079 | 6/1973 | Bossons | 242/58.1 X |
| 3,960,272 | 6/1976 | Hartbauer | 206/389 |
| 4,080,231 | 3/1978 | Tokuno | 156/502 X |
| 4,299,642 | 11/1981 | Berkholtz | 242/56 R |
| 4,597,820 | 7/1986 | Nozaka | 156/502 X |
| 4,802,632 | 2/1989 | Fukuda et al. | 242/58.5 |
| 4,905,924 | 3/1990 | Moore | 156/504 X |
| 4,984,750 | 1/1991 | Shigeta | 156/504 X |
| 5,030,311 | 7/1991 | Michal | 242/56 R X |

FOREIGN PATENT DOCUMENTS

| | | |
|---|---|---|
| 0129238 | 12/1984 | European Pat. Off. . |
| 2337663 | 2/1975 | Fed. Rep. of Germany . |

*Primary Examiner*—David A. Simmons
*Assistant Examiner*—Charles Rainwater
*Attorney, Agent, or Firm*—Frishauf, Holtz, Goodman & Woodward

[57] ABSTRACT

To prepare an initial portion (41) on a replacement roll (4) of a substrate web, for example a printing paper web, for flying pasting, the new roll (4) is rotatably supported in apredetermined position. An adhesive application and cutter structure (5) is then placed in operative association with the roll. An initial portion (41) of the web is rolled off from the new roll, positioned on the support plate, and, in one operating step, an end, which may be jagged, is cut off and, inwardly of the cut edge (42), a perforating or tear-off line (43) is formed, to leave, between the cut edge and the tear-off line, a tear-off section (44). The web can then be repositioned on the plate (6) and a connecting adhesive (19) is applied to the upper side of the web, for subsequent flying pasting against a moving expiring web, for example, as well as a holding adhesive, applied in the inside of the tear-off section (44), so that the end portion (41) is securely attached to the roll. Preferably, the cutter and perforating blades are located on a single support block; and the adhesive applicators, likewise, are retained on a common support structure, which may be coupled with the blade support structure, for conjoint movement across the web.

7 Claims, 10 Drawing Sheets

APPARATUS OF PREPARING A ROLL OF PRINTING SUBSTRATE WEB FOR FLYING PASTING

Reference to related patent, the disclosure of which is hereby incorporated by reference: U.S. Pat. No. 4,547,739, Beute.

Reference to related publications: European Patent Publication 0 129 238 Al of Dec. 27, 1984, Nozaka; DE 38 11 138 Al, Fukuda et al, to which U.S. Pat. No. 4,802,632 corresponds; DE 23 37 663 C2, Pflaum et al, the latter being assigned to the assignee of the present application.

FIELD OF THE INVENTION

The present invention relates to flying roll changes, and more particularly to changing the web from an expiring roll to a replacement roll while the webs are running, and more especially to an apparatus to prepare the replacement roll for such flying roll changing. This is also referred to at times as flying pasting of a roll.

BACKGROUND

Rotary printing machines, used for example for newspaper printing and other high-speed high-production printing, usually include at least one, and frequently a plurality of roll changer apparatus, in order to permit printing without interruption. The roll changers have apparatus for automatic adhesion of a new or replacement printing substrate web to a prior expiring web from a roll which is about or completely used up. Reliable adhesion of the beginning portion of the new roll on the web from the expiring roll is possible only if the new roll is prepared in a suitable manner for such adhesion. Frequently, such preparation is done manually. It can be carried out on the roll already positioned on the roll changer, or separately and in advance of the installation of the roll in the roll changer at a work station apart from the printing machine.

European Published Application EP 0 129 238 Al, Nozaka, describes a printing substrate web in which first, after removing wrappers surrounding the roll, and any damaged outer layers, the web is cut with a straight cut thereacross and a plurality of adhesive strips are placed between the top and immediately adjacent layer of the roll thereunder. The adhesive strips are formed with a perforation when the roll is installed in a roll changer in order to facilitate of the adhesive strips when the new web is rolled off against the expiring web.

U.S. Pat. No. 4,802,632, Fukuda et al, to which German Patent Disclosure Document DE 38 11 138 Al, corresponds, describes an apparatus and method in which two knives to make a V cut are arranged at both sides of the paper end and move towards the center of the paper roll as the roll is rewound. The result will be a V cut extending obliquely from both sides towards a center point. A plurality of paper wraps are severed to make a "broke", that is, an end scrap, which is accepted by a suitable receptacle. An adhesive is applied along the edge of the cut paper, and the end of the cut paper is rewound on the paper roll. This method can be carried out while the printing machine is still running.

The methods systems for flying roll changing have generally involve complex geometry at the initial portion of the web, resulting in a correspondingly complex geometry of the adhesive pattern for the connecting adhesive. The number and size of the adhesive strips, or adhesive application arrangements are complex and hence expensive. Preparation of a paper web roll, particularly for newspaper and other high-speed printing machines thus is possible only with substantial apparatus, which is space-consuming and very costly, while being used only intermittently.

THE INVENTION

It is an object of the present invention to provide a method and an apparatus which permits, with minimum space requirement and structural complexity, to prepare a substrate web, typically a paper web for use in a rotary printing machine, so that it is suitable for flying pasting or flying roll change. The initial geometry of the replacement web should be simple, and the system should permit to use readily available adhesives or adhesive strips while providing effective assurance against undesired loosening of the initial portion of the web from the roll while still permitting rapid run-off of the initial portion when engaged against an expiring web.

Briefly, the roll is rotatably supported for rotation about a given axis, preferably a horizontal axis, and an initial portion of the web from the new roll is rolled off and passed over a support plate. A cutter and perforating tool is passed across the end region of the initial portion so that, in one operating step, and effectively simultaneously, the end is cut and, inwardly of the cut edge, a tear-off perforation is formed. The cut line and the perforating line, preferably, extend essentially at right angles across the web, that is, parallel to the axis of rotation of the roll. A connecting adhesive is applied to the upper side of the web, e.g. while it is still on the support plate, in the region of the web inwardly of the perforating line, that is, remote from the cutting line or cut edge. A holding adhesive is applied on a surface segment of the web, the adhesive being so dimensioned and positioned on the web that, upon winding the initial portion back on the roll, the segment having the holding adhesive applied is entirely covered by the region of the rewound portion which is between the cut edge and the perforating line. The holding adhesive can be applied either to the underside of the initial portion in the region between the cut edge and the perforating line; or it can be applied to the upper side of the outmost layer remaining on the roll, so that, upon rewinding of the initial portion, the adhesive will be positioned beneath the tear-off strip defined by the cutting line and the perforating line.

The method and apparatus in accordance with the present invention has numerous advantages, for example:

Simple geometry of the initial portion of the replacement roll web, which can be generated, simply, by hand, or by simple, easily constructed and non space-consuming apparatus;

simple geometry of the adhesive region and the application apparatus for adhesive, both to form a connection to an expiring web as well as to hold the initial portion;

complex pasting strips and the like, or pasting elements such as pasting butterflies, which are difficult to handle due to adhesive characteristics need not be used;

reliable holding of the initial portion and assurance that the initial part will not release inadvertently upon acceleration and high-speed rotation of the roll in advance of joining to the expiring roll;

ready capability to match the perforation to the quality of the web, for example the per square weight of the paper, without requiring a plurality of perforators or cutter knives of different cutting geometry;

change of perforation pattern or perforation characteristics without changing perforators or cutter knives; and possibility of changing the width of the perforation strip, perforation patterns, and perforation steps, in continuous, stepless manner.

Various other advantages, and the suitability of the structure and method of the present invention will become apparent from the Detailed Description.

DRAWINGS

Figure 2:
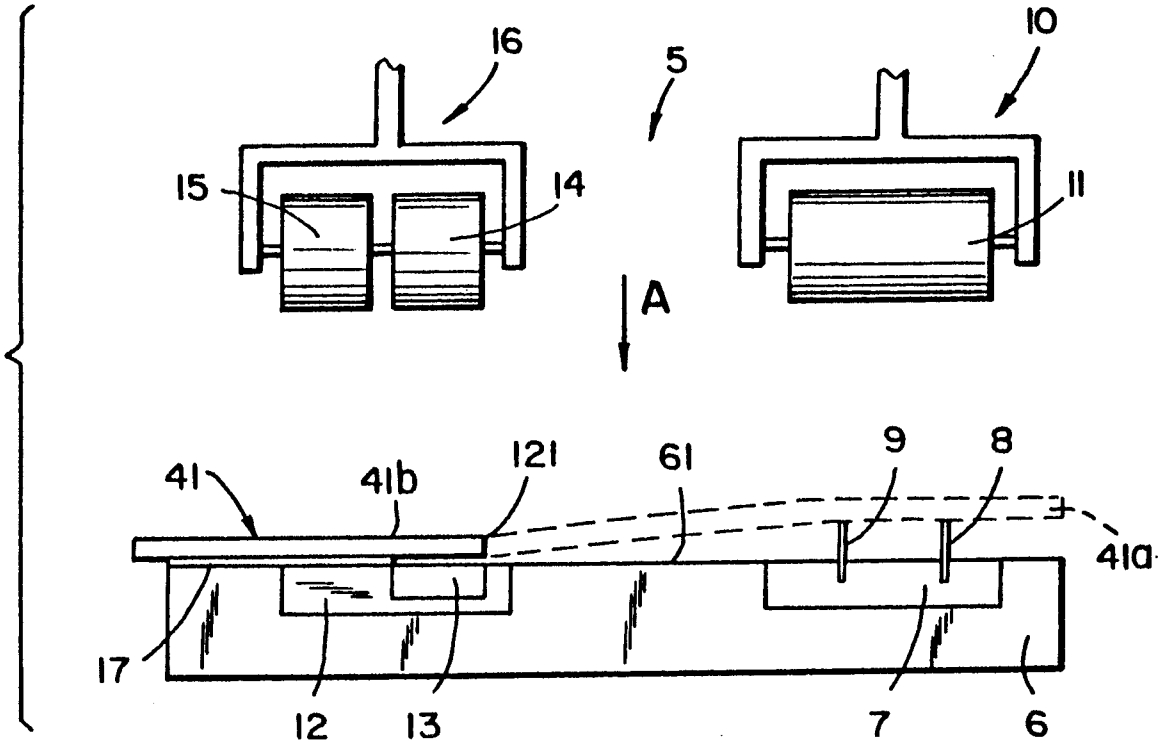
FIG. 2 is a highly simplified and schematic side view of an embodiment of the preparation device in accordance with the present invention.
Figure 4A:
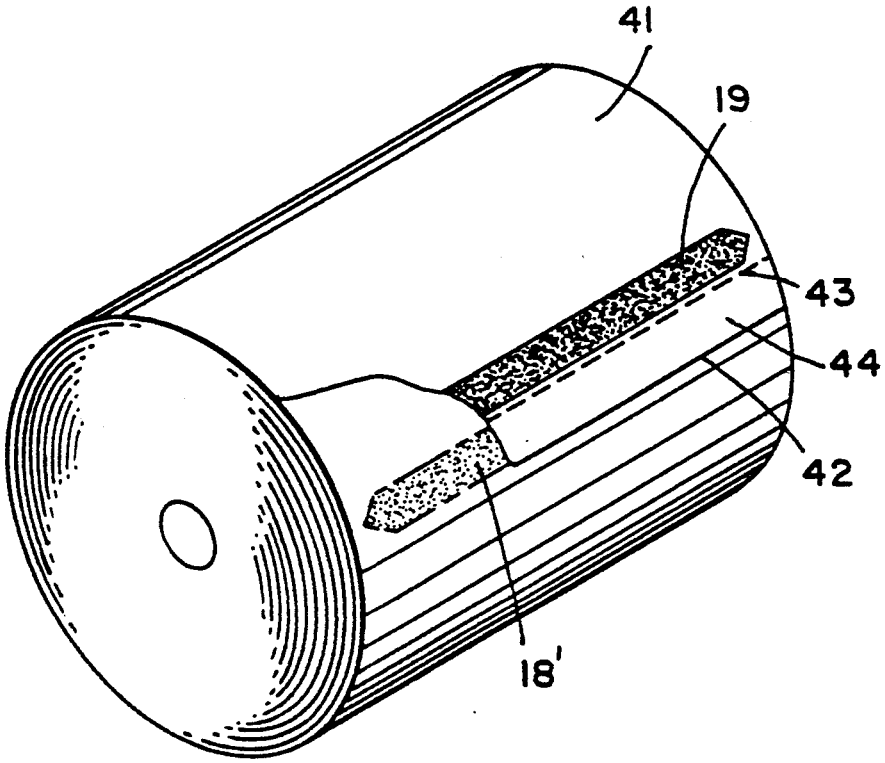
Figure 4B:
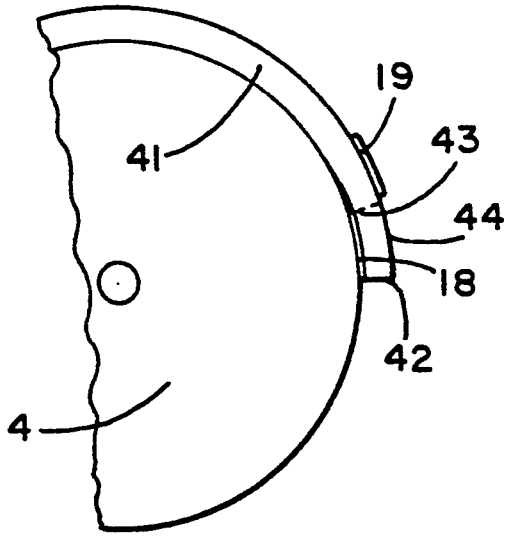
Figure 5:
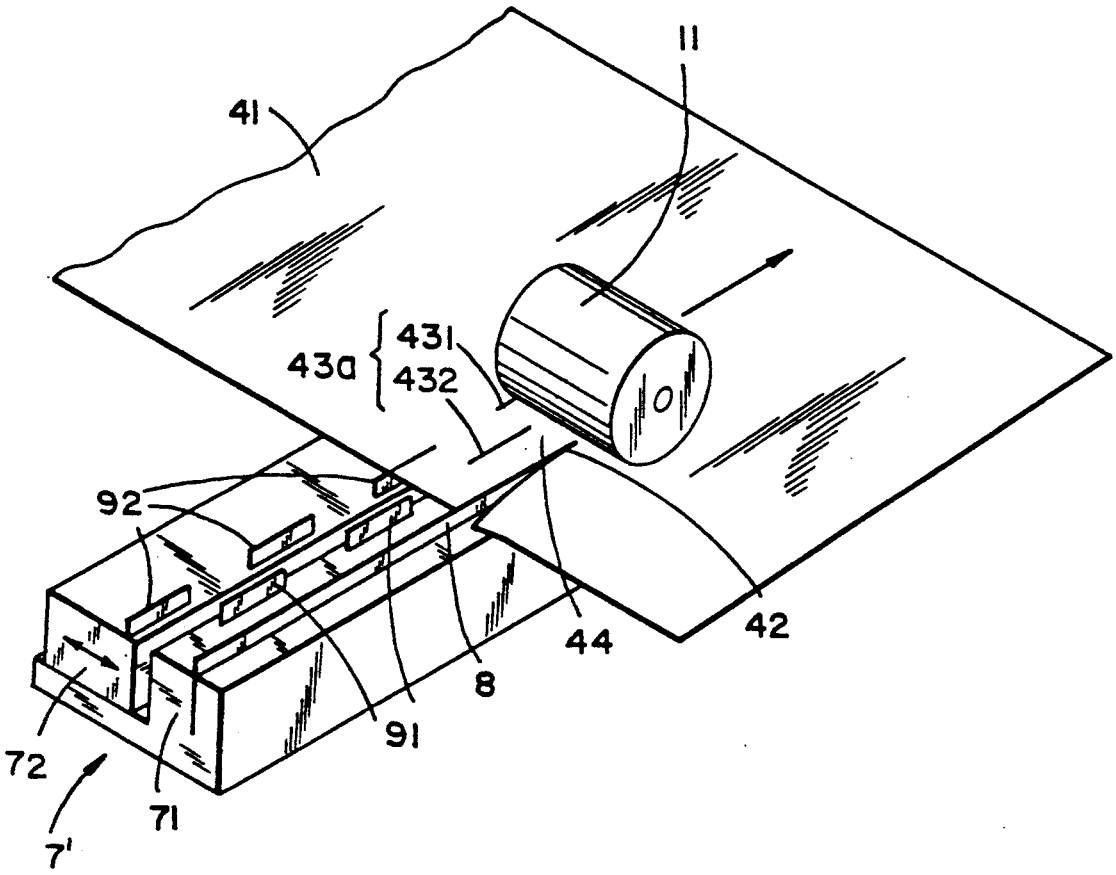
Figure 6:
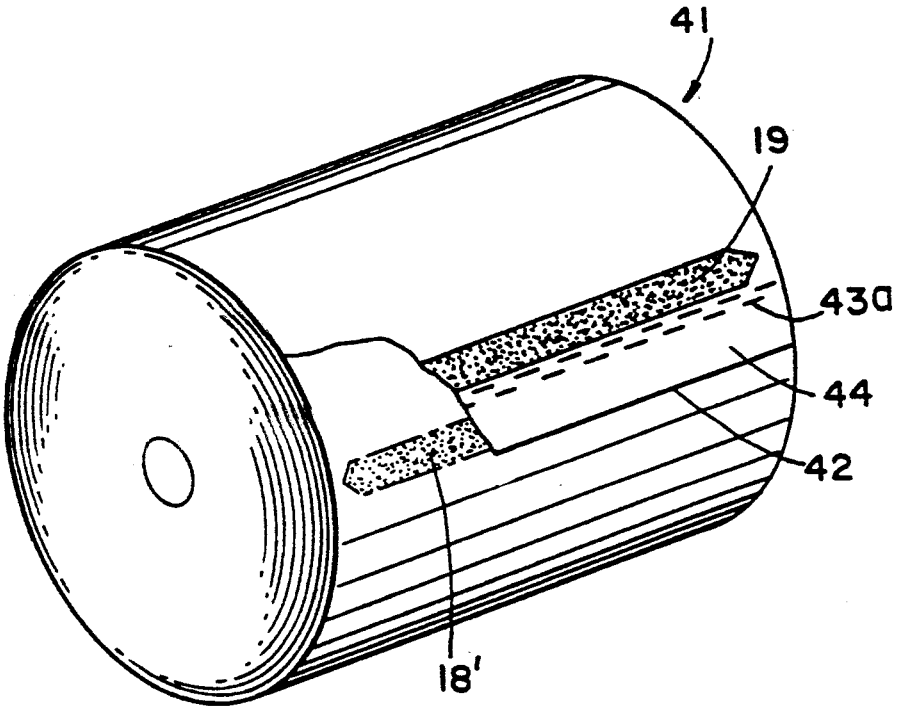
Figure 7A:
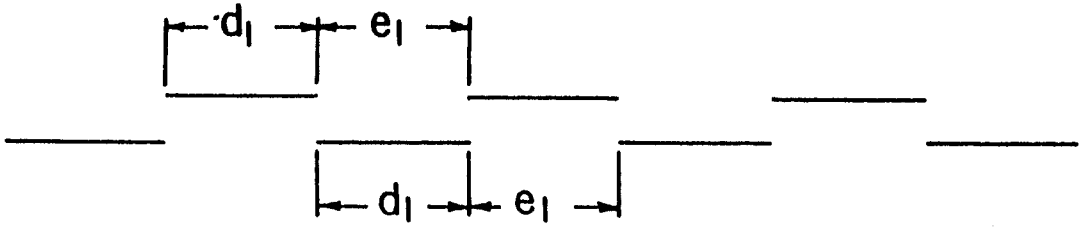
Figure 7B:
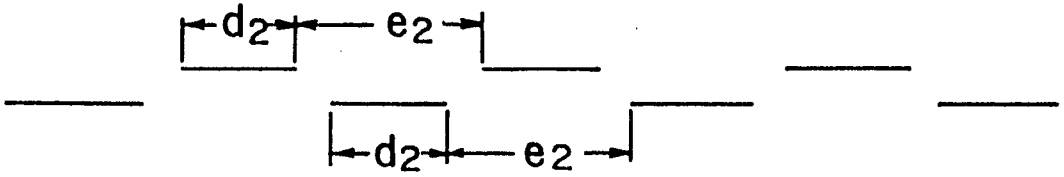
Figure 7C:
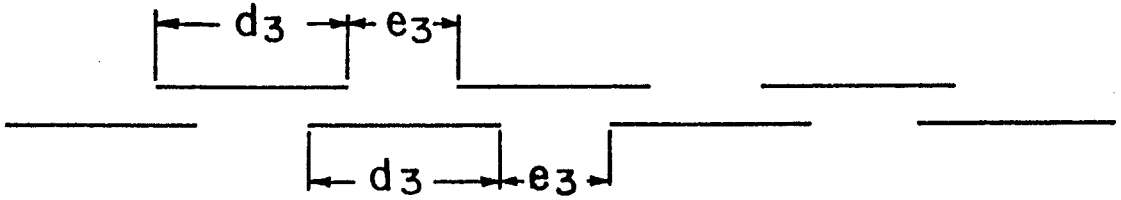
Figure 8A:
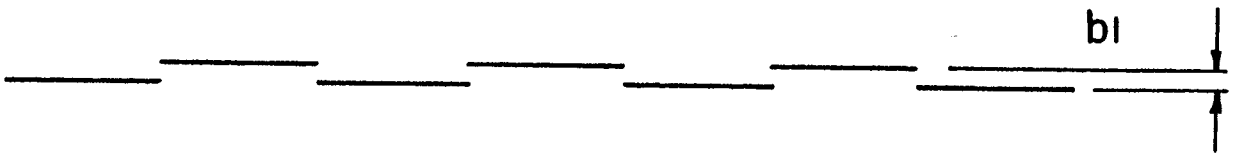
Figure 8B:
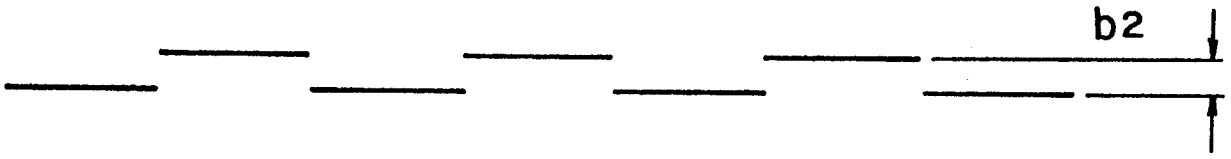
Figure 8C:
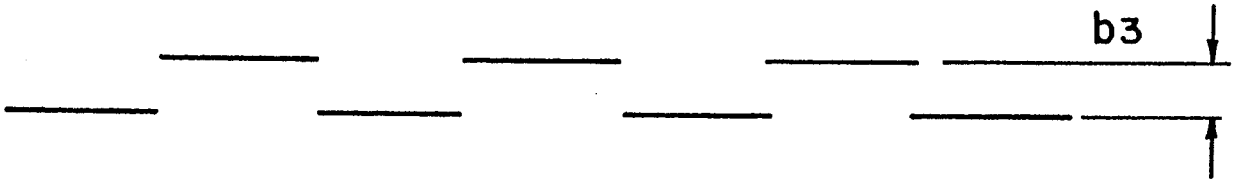
Figure 9:
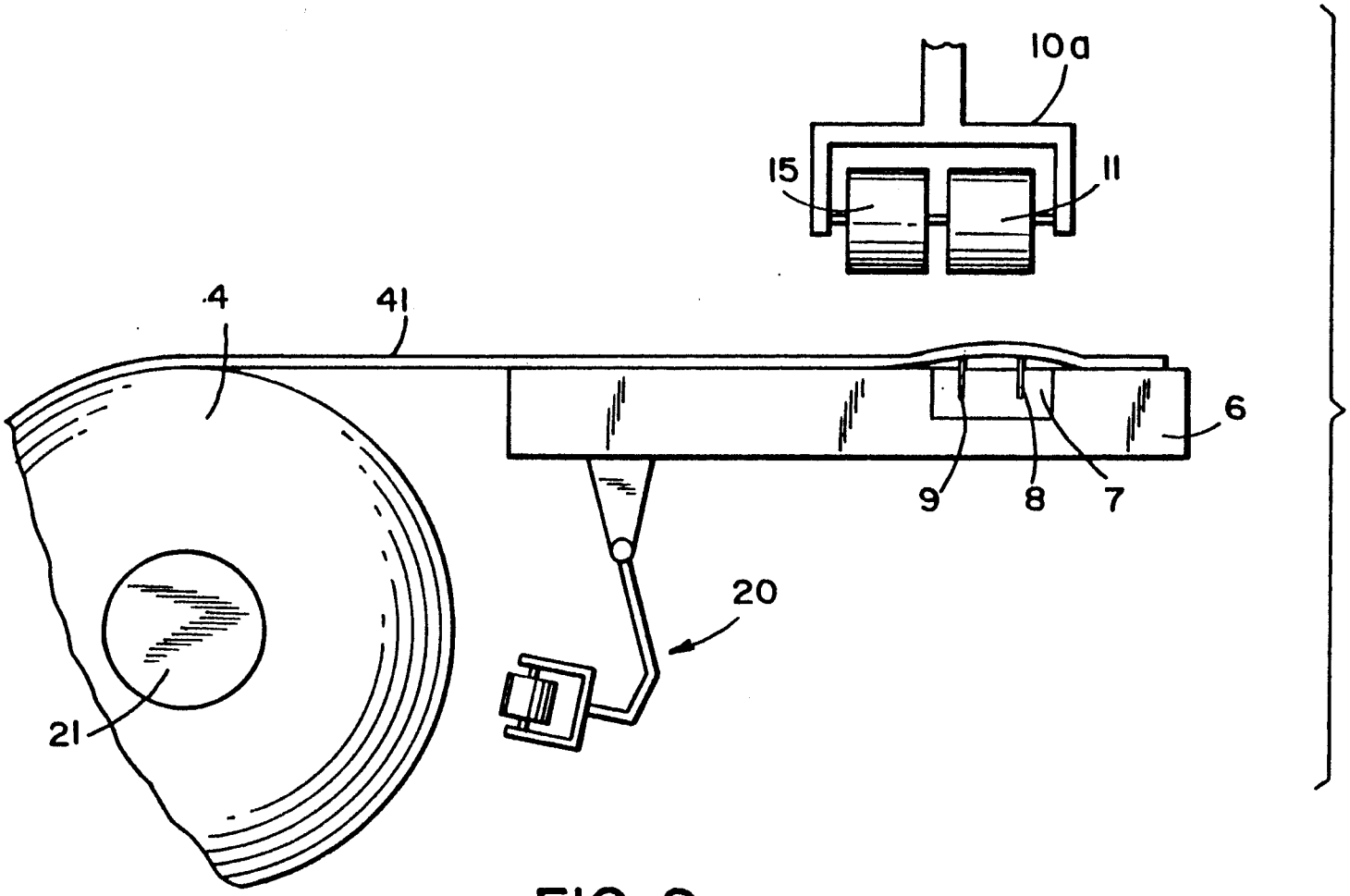
Figure 10:
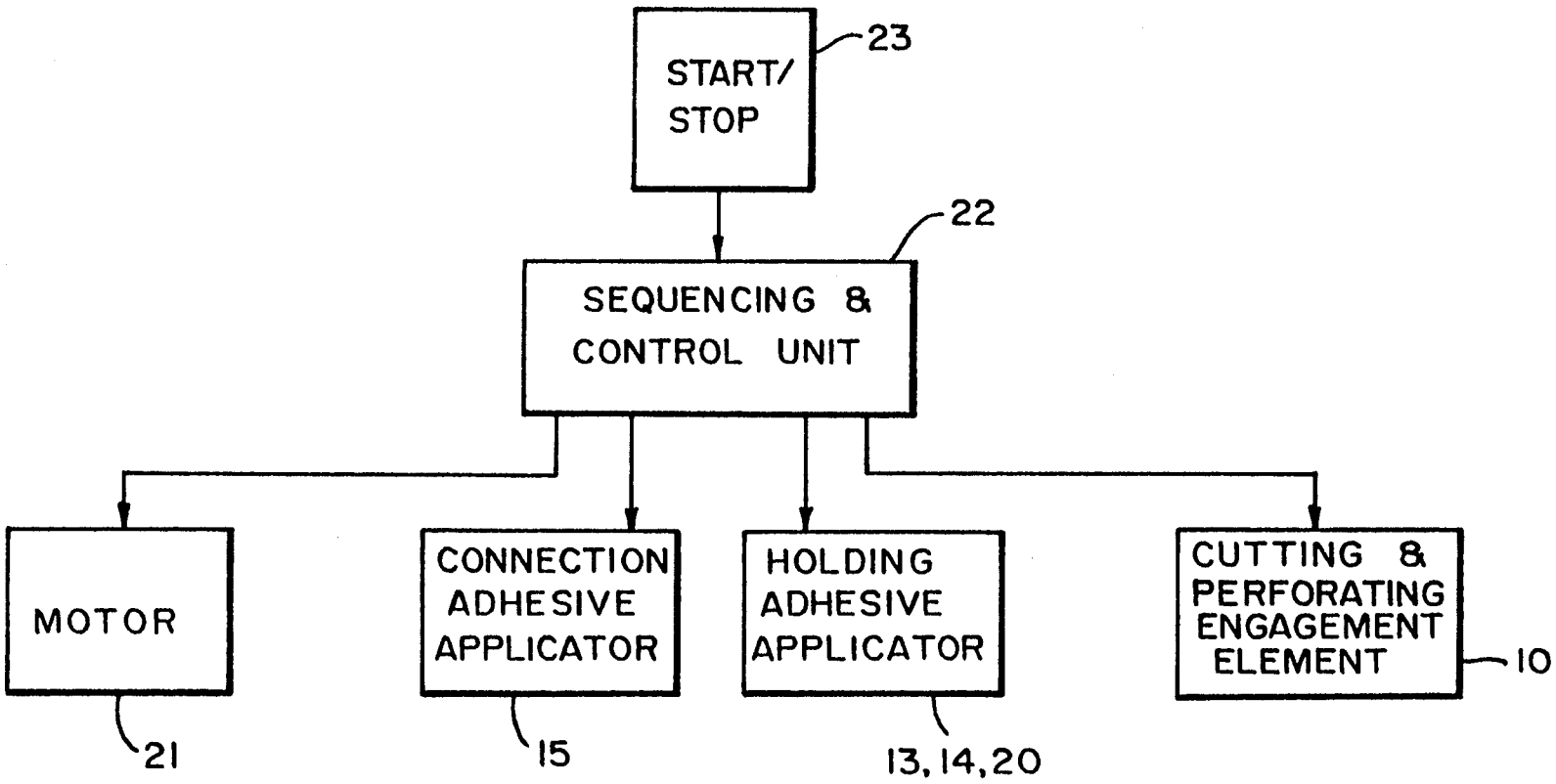

FIG. 4*a* is a perspective device of a roll prepared in accordance with an embodiment of the invention;

FIG. 4*b* is a schematic side view of the roll of FIG. 4*a*;

FIG. 5 illustrates another embodiment of the apparatus of the present invention insofar as the embodiment differs from the apparatus shown in FIG. 2;

FIG. 6 is a perspective representation of a roll prepared in accordance with another embodiment of the present invention;

FIG. 7 illustrates, highly schematically, in aligned representation of schematic graphs A, B, C, various perforation patterns possible with perforators illustrated in FIG. 5;

FIG. 8 illustrates, in aligned graphs A, B, C, different perforation patterns obtainable with perforators having relatively equal spacing;

FIG. 9 is a perspective side view of a modified apparatus in accordance with the present invention;

FIG. 10 is a schematic block diagram of a control circuit to control the roll-off of an initial portion of the replacement web from a replacement roll.

DETAILED DESCRIPTION

Figure 1:
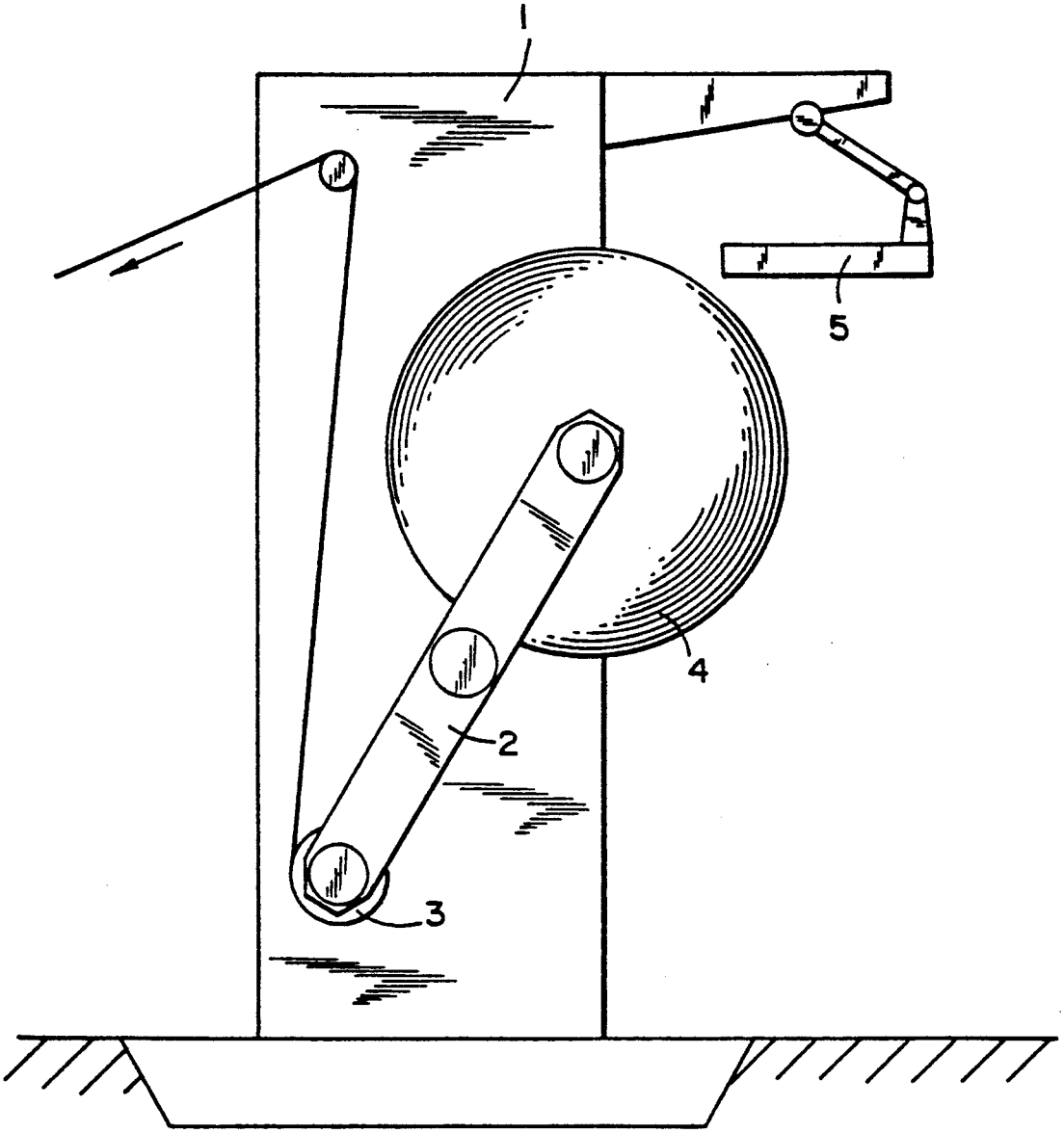
FIG. 1 is a highly schematic representation of a roll changer and the apparatus to prepare a replacement roll portion combined therewith.

Referring first to FIG. 1, which is a highly schematic representation of a roll changer including the device in accordance with the present invention to prepare a replacement web roll 4 for subsequent adhesion to an expiring web from an expiring roll 3. It is understood that the customary removal of wrapping paper and outer damaged or deformed layers of the roll 4 has been carried out. Such removal is usually done by hand or by special apparatus therefor, which do not form part of the present invention, and therefore are not specifically shown and described. The term "preparation" as used herein is intended to refer only to the preparation of the initial portion of the web from roll 4 which will be threaded into a subsequent utilization apparatus, typically a rotary printing machine. This preparation includes the formation of a tear or breakage line, and applying a connecting adhesive to the web on roll 4 for connection to the expiring web from roll 3, as well as the application of a holding adhesive to the initial portion to hold the beginning or initial portion on the roll 4 so that it will not form a loose flap. The connecting adhesive is so applied that adhesion of the replacement web from roll 4 on the moving expiring web from the expiring roll 3 is possible without interrupting movement of the webs; the adhesion of the end portion of the outer layer by the holding adhesive is so applied that this end portion or end flap will be adhered to the underlying layer of web on roll 4 so that the roll can be accelerated and rotated to the web removal speed prior to adhesion to the expiring web, without any loose flaps extending from the roll.

The roll changer includes a frame shown only schematically as a frame 1, and which may be of any well known construction. The frame rotatably supports a pivoting lever 2 on which the expiring roll 3 is journalled as well as the new replacement roll 4. Rolls 3 and 4 retain the web, typically a paper web for a rotary printing machine. An apparatus, generally shown at 5 in FIG. 1, and to be described in detail below, is secured to the frame 1 in such a manner that it can be placed into operative association with the roll 4 to prepare the initial portion of the outer layer of the roll 4 for adhesion. This apparatus 5 can be secured to the frame 1, as shown, or can be supported on an individual, preferably movable frame, in such a manner that it can be placed essentially in the position shown in FIG. 1 for preparation of the web on the new roll 4. When the roll is to be prepared, the apparatus 5 is placed in a fixed position with respect to the roll 4, so it does not unintentionally move with respect thereto.

FIG. 2 is a highly schematic representation of the first embodiment of the invention to prepare an initial portion 41 rolled off the substrate web roller 4. The position of the web 41 is shown in two ways: during the cutting and perforating step, the web 41 is pulled out to the position 41*a*, as shown in broken lines. When applying adhesives, it is pulled back into the position shown in full lines at 41*b*.

The apparatus 5 has a base plate 6 with an upper surface 61. The portion 41 of the web from the replacement roll 4 is placed on the surface 61. The base plate 6 carries a knife support block 7, extending transversely to the roll-off direction of the replacement roll 4, for example parallel to the axis of rotation thereto. The block 7 is flush with the surface 61, so that only the cutting edges of a cutting knife 8 and of a perforating blade 9 project from above the surface 61. The cutting knife 8, that is, the blade 8, and the perforating cutter or perforating blade 9 are spaced from each other by a distance a (see FIG. 3). They are parallel to each other. An engagement device 10 is provided which can be moved downwardly to engage the web 4*a* against the blades 8, 9 while being movable in a direction perpendicular to the plane of the drawing of FIG. 2, that is, across the web 41. Any suitable way of holding the engagement device 10 can be used; it is equipped with an elastic roller 11, for example a roller made of rubber.

In addition to the cutting block 7, an adhesive application plate or block 12 is fitted into a recess of the plate 6. The block 12 has an upper surface which is flush with the surface 61. The adhesive application block 12 has an upper surface 121, which is formed with a groove 13 in which a holding adhesive can be retained. The width of the groove 13, preferably, is somewhat smaller than the distance a between the blades 8, 9; in no case should it be greater than distance a. An application roller 4 is located above the holding adhesive groove 13, and movable transversely to the plane of the drawing of FIG. 2, that is, across the web 41. The width of the roller 14, preferably, is less than the width of the groove 13 retaining the holding adhesive. The depth of the groove 13 is shown in FIG. 2 highly exaggerated for better understanding of the drawing. A connecting adhesive application roller 15, and engageable against the web 41 and movable transversely with respect thereto, is located to the left of the blade block 7, and inwardly or behind the holding adhesive groove or channel 13. The connecting adhesive application roller 15 is so arranged that a small space remains between the two rollers 14 and 15. The connecting adhesive roller 15 may, for example, be a tape dispenser for a double-sided adhesive tape, or an application roller for a liquid or otherwise fluid adhesive. Preferably, but not necessarily, both rollers are located on a common frame 16, in order to permit the axial space between the two rollers to be accurately maintained and made as small as possible. The surface 121 of the block 12 as well as the surface 61 to the left (with respect to FIG. 2) of the plate 6 are coated with an anti-adhesive or adhesive-repellant coating 17. Movement of the holders 10, 16 towards the plate 6 is shown schematically by arrow A.

In accordance with a preferred feature of the invention, the blade block 7 and the adhesive application plate or block 12 can be constructed as a single element. If this is done, the elastic roller 11 as well as the holding adhesive enagagement roller 14 and the connecting adhesive application roller 15 can be retained in a common movable holder frame, combining the frames 10 and 16, so that cutting of the web edge 42 (FIG. 3), perforating the web inwardly—with respect to the rolled out portion of the web from roll 4—by the blade 9, and application of the holding adhesive as well as of the connecting adhesive can be carried out in a single operating step when moving the common frame across the width of the web, and without partially rolling up the web 41.

Figure 3:
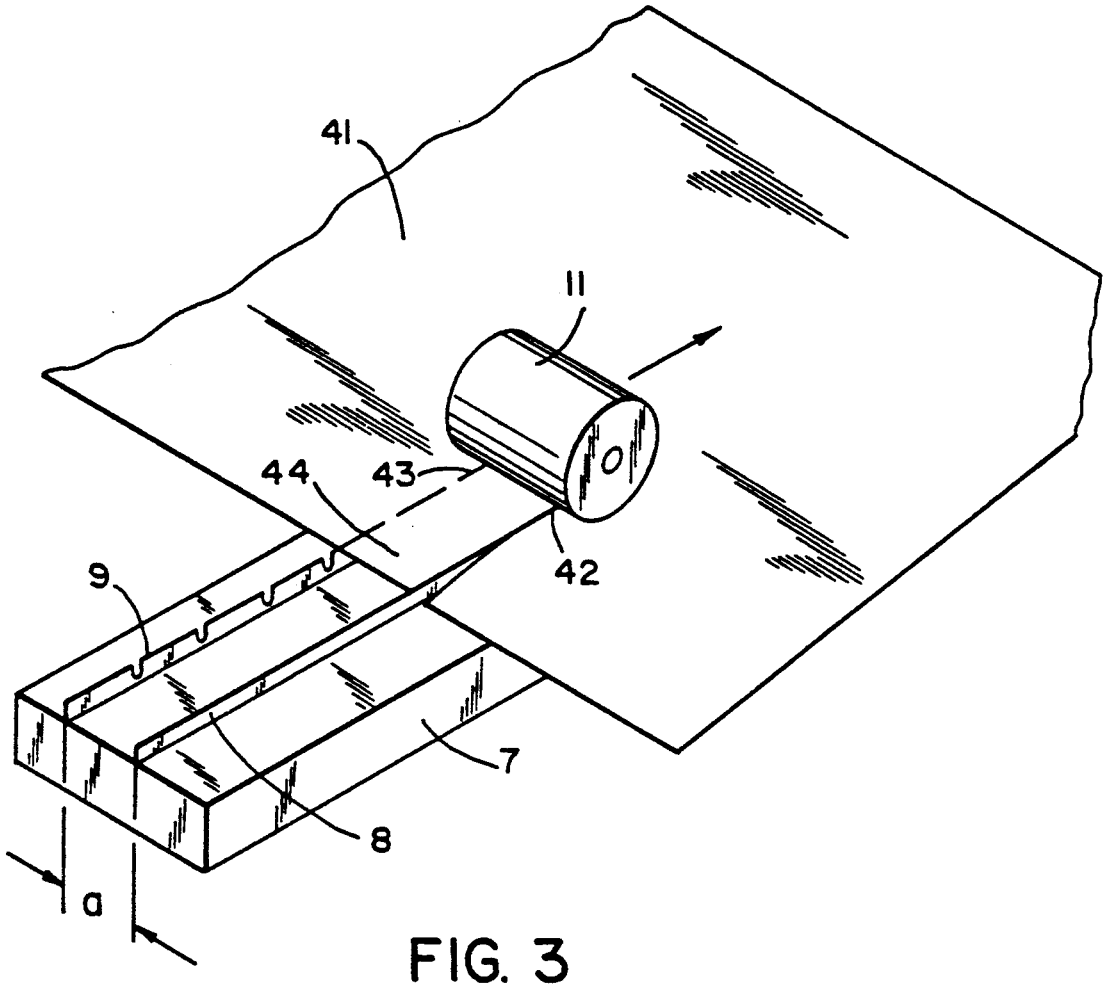
FIG. 3 is a perspective representation of the cutter and perforating portions of the device of FIG. 2.

FIG. 3 is a highly simplified and schematic perspective view of the blade block 7 with the cutting blade 8 and the perforating blade 9, as well as illustrating the engagement roller 11 of the apparatus 5 illustrated in FIG. 2. It is not necessary that the blade block 7 and the roller 11 operate at an angle of 90° with respect to the roll-off direction of the web 41; the angle can be less. Rather than providing a straight, transverse cut, the initial portion of the web will then have an inclined end region or cut edge. Rather than using an elastic roller 11 with an engagement frame 10, a different arrangement may be used, for example an elongated bar which may be faced with or entirely is made of rubber or a similar yielding material, and which presses the web 41 essentially simultaneously over the entire width of the web on the two blades 8, 9, and thus form the cut edge 42 as well as the perforation 43.

FIG. 4*a* illustrates, in a simplified perspective representation, the web roll 4 prepared, in accordance with the present invention, by the apparatus as described. The holding adhesive 18, some of which will have migrated from the strip 44 between the cut edge 42 and 43, is shown on the underlying turn or layer on the roller 4; this holding adhesive strip 18, of which the migrated portion 18' is shown, is necessary to hold the initial portion on the roll and prevent a loose flap from dangling from the roll. FIG. 4*a* as well as FIG. 4*b* also clearly show the connecting adhesive strip 19, as well as the perforation line 43 which ensures reliable tearing of the new web 41 from the roll 4.

Operation

The initial portion or pasting region of the new roll is prepared by the apparatus 5 illustrated in FIGS. 2 and 3 essentially in this manner:

First, the initial portion 41 is rolled off the roll 4 and placed on the base plate 6, so that the web 41 entirely covers the plate 6, that is, reaches over the adhesion block 12 as well as over the blade block 7, as shown by the broken line 41*a* in FIG. 2. The engagement apparatus 10 is then moved in the direction of the arrow A, against the blade block 7, so that the rubber roller 11, or an equivelent block, engages the web 41*a* against the blade block 7 and the blades 8 and 9 thereon. The engagement device 10 is then moved across the web, transversely to the plane of FIG. 2, towards the remote end of the knife block 7, so that the web 41, in the position 41*a*, is cut, in a single operating step, to provide a straight cut edge 42 (FIG. 4*a*) and a parallel perforation line 43. After the cut and perforation are completed, the web 41 is rolled up on the roll 4 by a predetermined length, which is so dimensioned that the cut edge 42 is positioned above the holding adhesive application groove or channel 13. This then simultaneously places the perforating line 43 on the surface 121 in the region which matches the spacing between the rollers 14 and 15.

Upon moving the engagment roller 14 and the application roller 15 in the direction of the arrow A, and then transversely to the plane of FIG. 2, two adhesives are applied on the web 41 in the position 41*b* in one single operating step. The adhesives may be different. The roller 14 applies a holding adhesive 18 to the underside of the web 41 in the portion 44 between the cut edge 42 and the perforation 43; additionally, the roller 15 applies a connecting adhesive 19 to the upper side of the portion 41 in the zone or region adjacent the perforation 43. The holding adhesive 18 and the connecting adhesive 19 can be applied in the same manner, or differently. Particularly, either one of the adhesives can be adhesive strips or tapes, as well as adhesive which can be painted or rolled on the substrate, or sprayed on the substrate. Additionally, the adhesives can have different adhesive strengths. Both adhesives, however, must be adhesive on both sides, that is, to adhere both to the portion 41 as well as to an underlying layer of the roll 5 and the expiring web from roll 3, respectively. In many installations it is customary to rotate the roller 4 by a belt engaging against the circumference of the roller. If this arrangement is used, the region of the substrate in which the belt engages the roller should be kept free of connecting adhesive 19. If a plurality of belts are used, a plurality of zones or regions free from adhesive should be provided.

For belt drive, it is frequently desirable to provide a different shape of the perforation in the region or regions where the belt engages. If a continuous perforation 43 is used, as shown for example in FIG. 3, and a non-continuous adhesive strip 19 is provided, non-uniform force transmission may result upon tearing off the perforation on the layer of the substrate web which is to be torn, resulting in uncontrolled or random tears in the region of the position where the belt or belts engaged the web. Perforations in the region of the belt or belts which have been found suitable and preferred, are triangular round or, most preferred, trapeze-shaped perforation configurations or lines.

After applying the adhesives as described, the portion 41 is rewound completely on the roll 4. The anti-adhesion or slipping layer 17 on plate 12 prevents application of the adhesive applied on the bottom side of the web 41 to the surface surface 121 of plate 12 or to the surface 61 of the base plate 6. Well known means can be used to rewind the initial portion of the web 41 on the roll 4, for example engagement rollers which are coated with a slippery adhesive-rejecting surface, to ensure that the web portion 41 is rolled on the roll 4 without air bubbles or entrapped air, and to ensure that the initial portion 41 is reliably adhered over its full width on the underlying layer of the web of roll 4.

In accordance with a feature of the invention, and modifying the arrangement previously described, the knife block 7 and the associated engagement apparatus 10 as well as the adhesive application block 12 and the associated connecting adhesive application device 15 can be constructed to be, each, pivotable, for example in and out of the way of the initial web portion 41. In dependence on the step of the process to be carried out, that is, whether cutting/perforating is to be done, or adhesive to be applied, the one or the other block is pivoted or slid in a position corresponding to the required position to carry out the particular operation, for example into the position of the blade block as shown in FIG. 2. Such an arrangement provides for higher mechanical construction elements than the specific example described, but it has the advantage that the initial portion 41 of the web, after cutting, can remain in one single position when the adhesive then is to be applied.

In accordance with another modification, the blade block 7 and the adhesive application plate 12 can be combined into a single unit. The perforating blade 9 as well as the cutter blade 8, if desired, can be recessed in the blade block 7 so that the dimensioning and guidance of the engagement roller 14 need not be determined accurately. Engagement of the application roller 14 with either of the blades 8 or 9 can thus be reliably prevented. In this arrangement, preferably, the engagement apparatus 10 as well as the connecting adhesive application roller 15 are preferably combined in a single element movable across the web portion 41.

It is not important that the engagement device 10 and the connecting adhesive application roller 15 are axially aligned with respect to each other, or, respectively, if they are located parallel to the axis, or staggered one behind the other, or located parallel to the axis and overlapping or placed in any other suitable manner. It is also not necessary that the engagement device 10, when not aligned axially, and movable from one side edge of the web to the other, moves ahead of or behind the connection adhesive application roller. In other words, and looked at from a time point of view, the sequence of whether the web is first cut and then adhesive is applied, or if adhesive is applied first and the web is then cut, can be selected as desired. The invention still retains the essential advantage, then, that the device 10 and the engagement connecting adhesive roller 15 need not be returned to an initial starting position after each operation.

FIG. 5 illustrates another embodiment of the invention which is similar to that previously described. The same reference numbers have been used where appropriate.

The blade block 7' carries not a single perforating blade 9 but, rather, a perforating blade pair formed of blades 91, 92, which are longitudinally—with respect to the web 41—staggered. The block 7' itself is formed by a blade holder 71, secured to the base plate 6 (FIG. 2) and a second blade holder 72 which is adjustable with respect to blade holder 71. The blade holder 71 carries, besides the cutter blade 8, the first group of perforating blades 91. The second blade holder 72 carries the second group of perforating blades 92. The first blade 91 is spaced by the distance a from the cutter blade 8 and positioned parallel thereto. The second blade 92 is spaced by a distance b—see the specific distances b1, b2, b3 of the graphs A, B, C of FIG. 8 from the first blade 91. Permitting the second blade holder 72 to be adjustable with respect to the first blade holder 71 permits varying the spaces b between the blades 91, 92 in such a manner that the desired perforation pattern of the perforation 43*a* (FIG. 5), formed by the partial perforations 431, 432, can be obtained.

The perforation which is obtained from the arrangement of FIG. 5 is shown, highly schematically, in FIG. 6. The initial portion 41 of the replacement web is seen, the holding adhesive 18', which will form on the layer immediately beneath the top end portion 41 upon application of the holding adhesive to the underside of the strip 44 between the cutting edge 42 and the perforation 43*a*, as well as the connecting adhesive strip 19 for connection of the replacement web on the expiring web, the perforations 43*a* ensuring reliable and clean tearing of the replacement web.

FIG. 7 illustrates, in the aligned graphs A, B and C, various patterns suitable for the perforation 43*a*, and which can be easily obtained by the system of FIG. 5 by suitable selection of the geometry of the perforating blades. Depending on the relationship between the perforating length d of each one of the blades 91, 92 and the spacing e between the two blades 91, 92, respectively, cuts made by the blade 91 and blade 92 may, in the direction of the cut, be joining each other as seen in graph A, spaced from each other as seen in graph B, and overlapping as seen in graph C. The respective lengths of the knives are shown by the dimensions d1, d2, d3, respectively; and the spacing between the knives by the dimensions e1, e2, e3.

In addition to the staggering of the blades, the spacing between the blades can further be changed as described above in connection with FIG. 8. This permits wide variations of the perforation geometry without changing the blades. In contrast to the perforation pattern shown in FIG. 7, the different perforation patterns in accordance with FIG. 8 are obtained with knives of the same size, but different spacing from each other. The cutter knife 8 is not shown in FIGS. 7 and 8 for simplicity of presentation.

FIG. 9 illustrates another embodiment in accordance with the present invention, in a highly schematic side view. The holding adhesive is not applied by a holding adhesive groove 13 and an associated engagement roller 14 but, rather, the holding adhesive 18 is applied by an application device 20 on the outermost layer of the web on the roll 4. The surface region of the outer zone on which the holding adhesive 18 is applied has to be determined, both with respect to size, geometric configuration and arrangement on the roll, that the region 44 defined by the edge 42 and the perforation 43, or 43*a*, respectively, completely covers the surface region on which the holding adhesive is applied when the end portion 41 is wound back on the roll 4. FIG. 9 also, schematically, shows a motor 21 for rewinding the end portion and/or assisting in rolling or spooling off the end portion 41.

FIG. 9 illustrates a further modification in that the engagement roller 11 to press the end portion 41 against the cutter blade 8 and the perforating blade 9 as well as the connecting adhesive application roller 15 are located on a common holder element 10*a*. Alternatively, the rollers 11 and 15 can be retained on separate holder elements, as described in connection with FIG. 2. Any suitable arrangement may be used. It does not matter whether the engagement roller 11 and the connecting adhesive application roller 15 are axially aligned or axially parallel to each other behind each other, or axially parallel overlapping each other. Upon non-axial alignment of the application roller 11, it is also immaterial if, upon movement of the holder 10*a*, the engagement roller 11 leads the application roller 15 or, respectively, trails the application roller 15, so that, looked at from a time point of view, the web is first cut and then has adhesive applied thereto-or the reverse is carried out. The advantage of the present arrangement is retained, in that the engagement roller 11 and the connecting adhesive application roller 15 need not be returned to an initial or starting position, but can merely travel across the web, stop at the remote end, and for a subsequent preparation step, reverse the prior direction of movement.

In a different arrangement the cutter blade 8 and the perforating blade 9 can be located in a movable holder, which is pressed on an engagement element in the base plate 6.

FIG. 10 illustrates, in schematic block diagram form, a control system for controlling the partial and complete winding of the initial portion 41 of the roller 4, in combination with sequenced, timed activation of the engagement apparatus 10, the adhesive application devices 13, 14, 20, and the connecting adhesive application device 15. An input start-stop circuit, for example operated manually, or by an external signal, activates the sequencing in control unit 22, which is connected to the cutting and perforating unit 10, the connection adhesive applicator 13, 14, 20, the connecting adhesive applicator 15 and the motor 21, respectively. After first triggering a preparation sequence, and after rolling off the initial portion 41 from the new roll 4, sequential energization or activating signals are applied to the respective elements to obtain, essentially, the following sequence of operation:

The engagement apparatus 10 is engaged against the cutter block 7 and moved from one lateral edge of the web portion 41 to the other lateral edge thereof in order to generate, in one operating step, the cut edge 42 and the parallel perforation 43, or 43*a*, respectively;

the initial portion 41 is wound backwards or wound up on the roll by a predetermined length, which is at least the length a, so that the cutter edge 42 will be in the position on the plate 6 which is shown in FIG. 2;

the second application roller 14 of the holding adhesive application element is moved at the same time as the connecting adhesive application roller 15 is engaged against the initial portion 41 of the web, and traversed from one lateral longitudinal edge of the web portion 41 to the other longitudinal edge thereof, so that the holding adhesive strip 18 and the connecting adhesive strip 19, as above described, are applied in one operating step. If the embodiment of FIG. 9 is utilized, rather, the holding adhesive application element 20 is engaged against the replacement roller 4 while, simultaneously, the connecting adhesive applicator roller 15 is engaged against the initial portion in order to, as described above, apply the connecting adhesive 19 as well as the holding adhesive 18; and the initial portion 41 is then completely rewound on the roller 4, so that, as above described, a new roller 4 is obtained, prepared for flying adhesion to the web from an expiring roll, or a web which is to be replaced by the replacement web on roll 4.

Various other changes and modifications are possible, and the sequence of the respective steps above described can be changed. For example, it is also possible to merely cut and perforate the edge portion, and applying the holding adhesive; and then to wind up the web end portion 41 completely and, by utilizing an apparatus similar to apparatus 20, applying the connecting adhesive strip 19 on the roll 4, while the beginning portion 41 is already preliminarily adhered by the previously applied holding adhesive strip 18.

The system of FIG. 10 is shown only in highly schematic and simplified manner, omitting any connecting lines for feedback signals and the like. Such feedback arrangements are preferably used to ensure appropriate sequencing and functioning of the control system. Other suitable connections, for example to provide interlocks for respective operations so that structural elements do not engage against each other or carry out uncontrolled movements have been omitted, since such interlocks are well known and reliability control of operation can be obtained in accordance with well known engineering practice.

We claim:

1. An apparatus for preparing a web on a new roll (4) of a printing substrate for flying pasting, said apparatus comprising a base plate (6) adapted to receive an initial portion (41) of the web, rolled off from said roll (4);

cutter knife means, retained essentially perpendicularly to the major plane of the initial portion (41) of the web;

perforating blade means (9, 91, 92) positioned essentially parallel to the cutter knife means (8) and spaced therefrom by a predetermined distance (a) to define, between the cutter knife means and the perforating blade means, a tear-off section (44) on the initial portion of the web, said cutter knife means, in operation, generating a cut edge (42) of the web and said perforating blade means (9, 91, 92) generating a tear or perforating line (43);

engagement means (10, 11) for engaging the cutter knife means (8) and the perforating blade means (9, 91, 92) against the initial portion (41) of the web, simultaneously, to effect, in one operating step, simultaneous cutting and perforating of said initial portion of the web;

a holding adhesive application means (13, 14; 20) for applying a holding adhesive (18) on a surface segment of the initial portion of the web which is within said tear-off section (44); and connection adhesive application means (15) applying a connecting adhesive on the initial portion of the web inwardly, with respect to said roll, of said tear-off section (44) and on an outer surface of the initial portion of the web with respect to the surface of the roll.

2. The apparatus of claim 1, further including a common blade retention block (7) retaining both said cutter knife means (8) and said perforating blade means (9, 91, 92).

3. The apparatus of claim 1, further including a movable blade retention block retaining both said cutter knife means (8) and said perforating blade means (9, 91, 92);

a web engaging counter plate being positioned at a surface of said initial portion opposite the blade retention block for engaging the initial portion of the web against said cutter knife means and said perforating blade means;

4. The apparatus of claim 1, further including an adhesive application plate (12) formed with a holding adhesive retention groove or channel (13) secured to said support plate (6), said holding adhesive retention groove or channel retaining a holding adhesive (18) for adhesion of the initial portion (41) of the web against the roll (4);

said cutter structure further including a first roller means (15) for application of the connection adhesive (19) and a second roller means (14) in alignment with said holding adhesive retention groove or channel, said first and second roller means being commonly movable across the initial portion of the web, and said second roller means being located in alignment with said tear-off section (44) for applying the holding adhesive on at least a surface segment of said tear-off section, said holding adhesive retention groove or channel (13) and said second roller means (14) forming the holding adhesive application means.

5. The apparatus of claim 4, further comprising a common support means for said first and second roller means (15, 14) to permit simultaneous application of said connection adhesive (19) and of said holding adhesive (18) to said initial portion of the web.

6. The apparatus of claim 1, wherein said adhesive application means (13, 14, 20; 15) comprise movable roller means, which are movable in a path transverse to the width of said initial portion of the web and essentially parallel to the axis of rotation of said roller.

7. The apparatus of claim 1, further including control means controlling, respectively, rotation of said roll to pay out the initial portion and, after cutting and perforating, and applying the adhesives by the adhesive application means, rewinding of the initial portion, said control means including a control and sequencing unit connected to and controlling movement of the cutter knife means (8) and the perforating blade means (9) for conjoint operation, the holding adhesive application means (13, 14, 20) and the connecting adhesive application means (15) for, selectively, conjoint or sequential operation; and a motor means (21) coupled to the roll for permitting paying out of said initial portion of the web and rewinding thereof on the roll.

* * * * *